US006443711B1

(12) United States Patent
Miller, Jr.

(10) Patent No.: US 6,443,711 B1
(45) Date of Patent: Sep. 3, 2002

(54) INLET BEARING LUBRICATION FOR A SCREW MACHINE

(75) Inventor: Frederick L. Miller, Jr., Syracuse, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/711,422

(22) Filed: Nov. 14, 2000

(51) Int. Cl.[7] ..... F04B 39/02
(52) U.S. Cl. ..... 417/372; 418/97
(58) Field of Search ..... 417/372, 410.3, 417/366; 418/97, 100, 201.1; 62/197, 402

(56) References Cited

U.S. PATENT DOCUMENTS 3,859,815 A * 1/1975 Kasahara ..... 62/197
4,311,021 A * 1/1982 Leo ..... 62/402
6,302,667 B1 * 10/2001 Timuska et al. ..... 418/201.1

* cited by examiner

*Primary Examiner*—Mark Paschall
*Assistant Examiner*—Quang T Van

(57) ABSTRACT

The inlet bearings of a screw machine, such as a refrigerant compressor, are both lubricated and cooled by a portion of the motor cooling and suction flow which has lubricant entrained therein and which is drawn through the inlet bearings into the coacting pair(s) of screw rotors.

3 Claims, 7 Drawing Sheets

INLET BEARING LUBRICATION FOR A SCREW MACHINE

BACKGROUND OF THE INVENTION

In screw machines such as refrigerant compressors, the refrigerant being compressed tends to move the screw rotors towards the suction side and away from the discharge side. Because separation of the rotors from the discharge side represents a leak passage, the discharge side bearings and related structure tend to severely limit movement of the rotors away from the discharge. Commonly assigned U.S. Pat. No. 5,975,867 discloses structure associated with the discharge side bearings for limiting movement of the screw rotors. The suction side bearings are much less loaded due to the movement restraint applied to the rotors by the discharge side bearings and their related structure. The suction or inlet side bearings are free to move in the direction of rotation of the rotors they support. They hold the position of the rotors only in their radial direction.

The suction side bearings are located in a diametrically extending bridge or webbing located between the motor and screw rotors so as to provide support for the inlet or suction side bearings, and thereby the screw rotors, while permitting fluid communication between the motor chamber and the suction of the compressor via flow around the bridge or webbing. Additionally, the bridge typically provides a portion of the inlet bearing lubrication paths in combination with external lines and/or "gun drilling" in the compressor housing structure.

SUMMARY OF THE INVENTION

There is an affinity between refrigerants and lubricants such that the refrigerant in a refrigeration system normally has some oil therein. According to the teachings of the present invention, the inlet bearings are supported in an open structure such that they are exposed to and thereby lubricated and cooled by the oil containing suction and motor cooling flow as it passes from the motor/suction chamber to the inlets of the coacting pair(s) of rotors.

It is an object of this invention to eliminate separate lubrication structure for the inlet bearings.

It is another object of this invention to simplify manufacture and reduce manufacturing costs. These objects, and others as will become apparent hereinafter, are accomplished by the present invention.

Basically, the inlet bearings of a screw machine, such as a refrigerant compressor, are both lubricated and cooled by a portion of the motor cooling and suction flow which has lubricant entrained therein and which is drawn through the inlet bearings into the coacting pair(s) of screw rotors.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
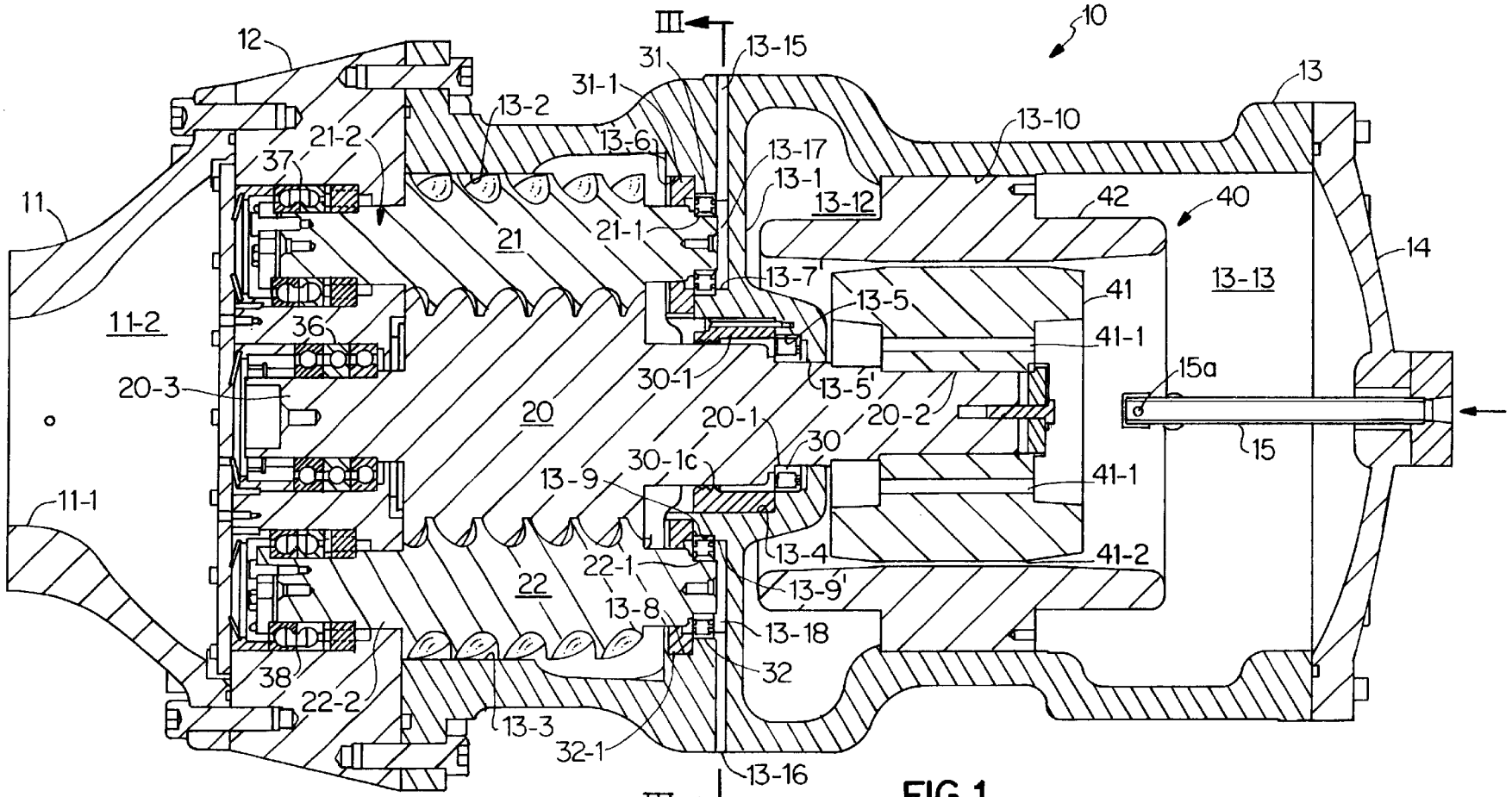
FIG.1 PRIOR ART
FIG. 1 is a sectional view of a screw machine having separately lubricated inlet bearings.
Figure 2:
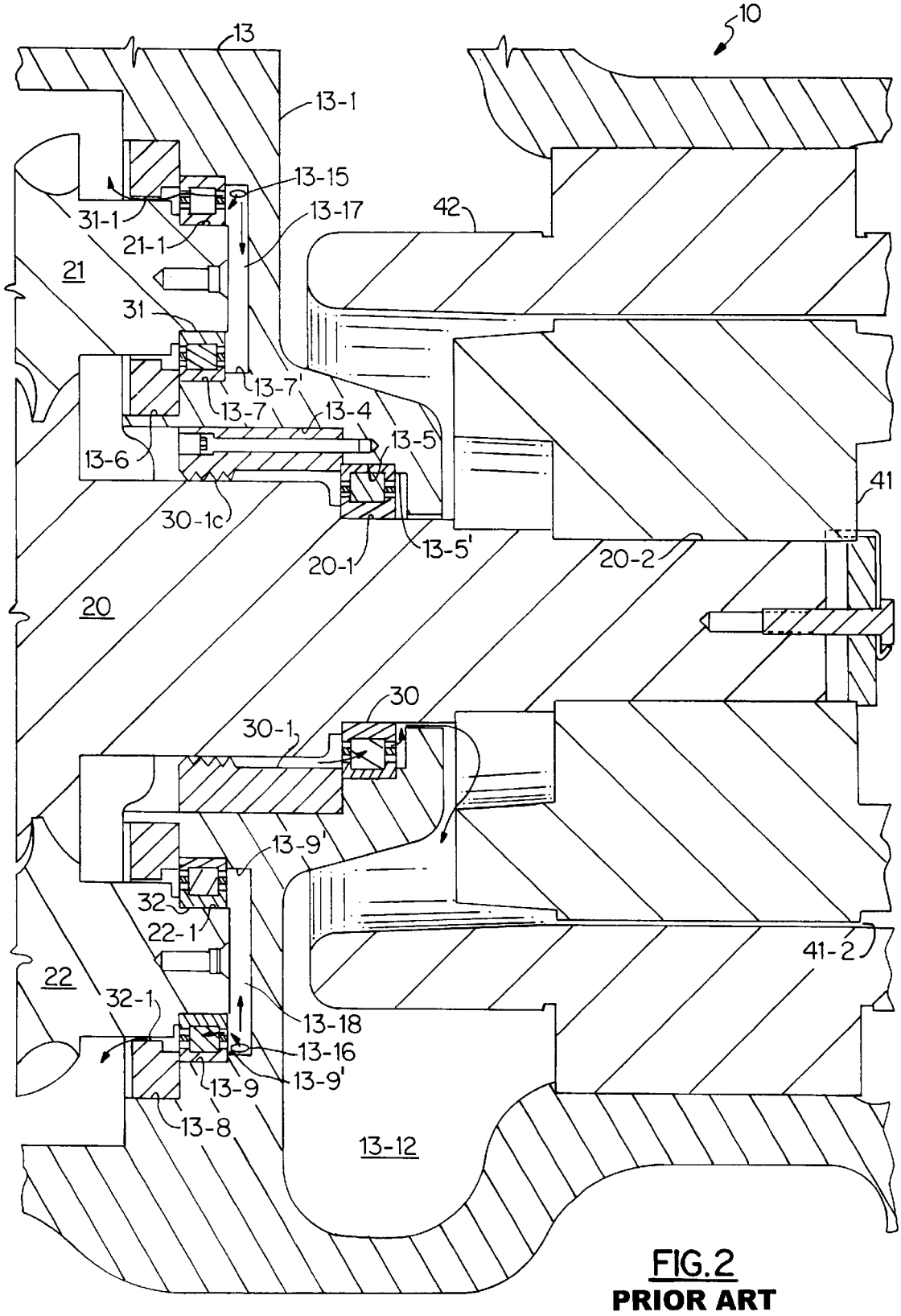
FIG.2 PRIOR ART
FIG. 2 is an enlarged view of a portion of FIG. 1.
Figure 3:
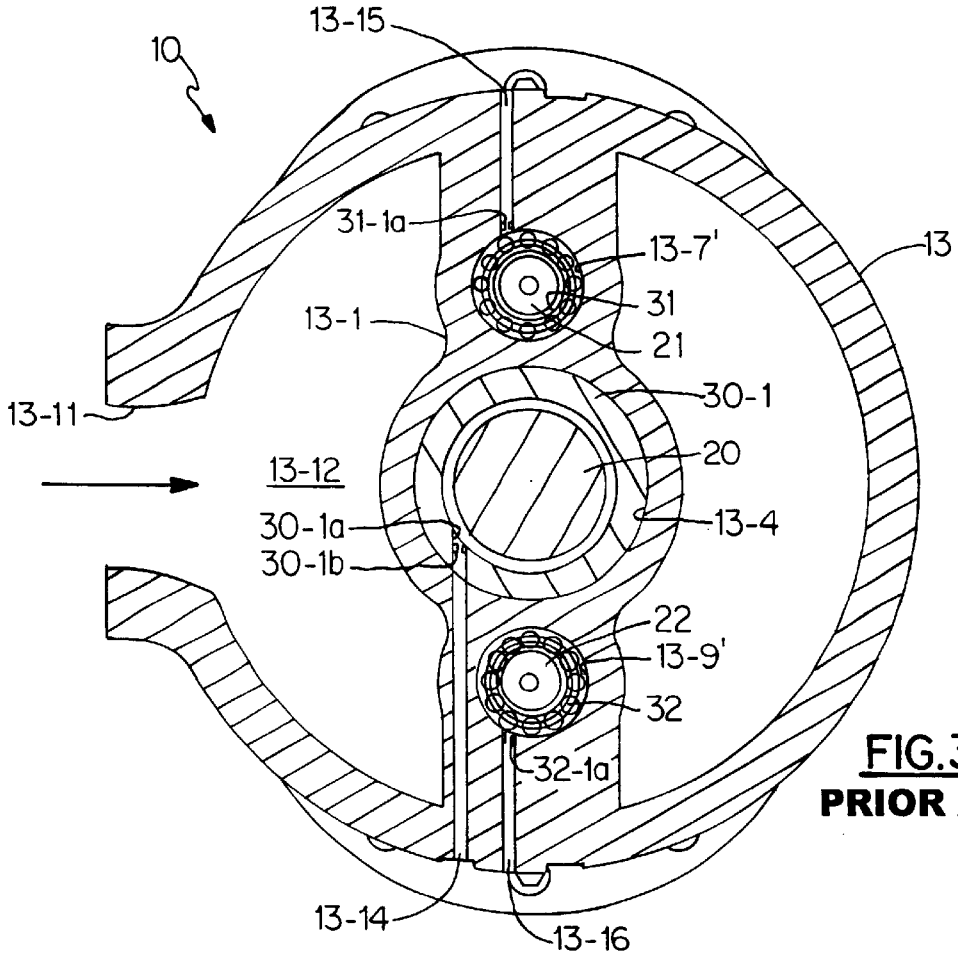
FIG.3 PRIOR ART
FIG. 3 is a sectional view taken along lines III—III of FIG. 1.

In FIGS. 1 through 3 the numeral 10 generally designates a screw machine which is illustrated and described as a three rotor refrigerant compressor. Compressor 10 has a male rotor 20 having a shaft portion 20-1 which is received in and supported by inlet bearing 30 and has a reduced diameter shaft portion 20-2 to which motor rotor 41 of electric motor 40 is shrunk fit or otherwise suitably secured. Male rotor 20 is driven by electric motor 40 and, in turn, drives female rotors 21 and 22, respectively. Rotors 21 and 22 have shaft portions 21-1 and 22-1, respectively, which are received in and supported by inlet bearings 31 and 32, respectively. Inlet bearings 30, 31 and 32 are roller bearings which support the radial loads created by the compression cycle on rotors 20, 21 and 22, respectively.

Compressor 10 serially includes discharge cover 11, outlet casing 12, rotor and motor housing 13 and motor cover 14 which are suitably secured together to form a semi-hermetic unit. If necessary, or desired, for manufacturing reasons, rotor and motor housing 13 may be made as two pieces, one of which could include cover 14 which could then be eliminated as a separate piece. Rotor and motor housing 13 is divided by a diametrically extending bridge or webbing 13-1 which, as best shown in FIG. 3, is the location of a plurality of passages in housing 13 and which serves to separate female rotors 21 and 22 from motor 40 while permitting fluid communication in rotor and motor housing 13. Rotor bores are formed in rotor and motor housing 13 and overlap for coacting pairs of rotors. Only rotor bores 13-2 and 13-3 for rotors 21 and 22, respectively, appear in FIG. 1. Axially spaced, coaxial bores 13-4, 13-5 and 13-5' are formed in bridge 13-1 and form a passage therethrough. Bores 13-4 and 13-5 receive bearing retainer 30-1 and its bearing 30, respectively. Axially spaced coaxial bores 13-6 and 13-7 receive bearing retainer 31-1 and its bearing 31, respectively. Similarly, axially spaced coaxial bores 13-8 and 13-9 receive bearing retainer 32-1 and its bearing 32, respectively.

Stator 42 of electric motor 40 is suitably secured in bore 13-10 of rotor and motor housing 13, as by a force fit or locked with a key in a slot. Suction gas containing entrained lubricant enters chamber 13-12 in rotor and motor housing 13 via inlet port 13-11. A motor cooling flow which may be a diverted portion of the suction flow, but is preferably at least partially liquid refrigerant, such as economizer flow, having oil entrained therein is supplied through motor cover 14 and tube 15 into chamber 13-13 via radial openings 15a in tube 15. Any liquid refrigerant flashes in chamber 13-13 due to the heat from motor 40. Suction created by rotor 20 coacting with rotors 21 and 22 draws refrigerant vapor and the oil droplets therein through motor 40. Chamber 13-13 communicates with chamber 13-12 where the motor cooling flow combines with the suction flow after it passes through passages 41-1 in rotor 41 or through the annular clearance 41-2 between rotor 41 and stator 42.

As best shown in FIG. 3, inlet bearing 30 is lubricated by lubricant supplied via a flow path which serially includes bore 13-14 in bridge 13-1, passage 30-1*a* in bearing retainer 30-1 containing a flow controlling orifice or restriction

30-1*b*, and bearing 30 before combining with the suction and motor cooling flows in chamber 13-12. As best shown in FIG. 2, bearing retainer 30-1 has a labyrinth seal portion 30-1*c* which provides a greater restriction to flow of lubricant than bearing 30 and so only leakage flow takes place past labyrinth seal portion 30-1*c*. Inlet bearing 31 is lubricated by lubricant supplied via a flow path which serially includes bore 13-15 in bridge 13-1 containing a flow containing orifice or restriction 31-1*a*, the chamber 13-17 defined by blind counter bore 13-7', and bearing 31 before combining with the suction and motor cooling flows in chamber 13-12. Similarly, inlet bearing 32 is lubricated by lubricant supplied via a flow path which serially includes bore 13-16 in bridge 13-1 containing a flow containing orifice or restriction 32-1*a*, the chamber 13-18 defined by blind counter bore 13-9', and bearing 32 before combining with the suction and motor cooling flows in chamber 13-12. These combined flows go through a compression cycle, are discharged and then pass through an oil reclaim system (not illustrated) where the oil is reclaimed and returned to the compressor 10 to lubricate bearings 30, 31 and 32.

Male rotor 20 has a discharge end shaft portion 20-3 which is received in and supported by a plurality of discharge bearings 36. Female rotors 21 and 22 have discharge end shaft portions 21-2 and 22-2, respectively, which are received in and supported by a plurality of discharge bearings 37 and 38, respectively. Bearings 36, 37 and 38 are received in and supported by outlet casing 12 which defines flow paths (not illustrated) between the discharge of coacting pairs of rotors and the compressor discharge chamber 11-2 formed in discharge cover 11.

Ignoring leakage, the only fluid communication between suction chamber 13-12 and the discharge port 11-1 is through coacting pairs of rotors. Specifically, as illustrated, rotor 20 is driven by motor 40 and coacts with rotors 21 and 22 to continuously define volumes therebetween which serially expand while being exposed to suction chamber 13-12, are sealed off and reduced in volume thereby compressing the trapped volumes of gas. The compressed trapped volumes are exposed to discharge chamber 11-2, and the exposed volumes are reduced in volume so that the contents of each trapped volume is delivered to the discharge chamber 11-2. As the trapped volumes are formed, gas is removed from the suction chamber 13-12 such that a pressure differential is created which tends to cause: (1) suction gas to flow into suction chamber 13-12 via inlet port 13-11; (2) motor cooling fluid supplied via tube 15 to pass between and cool rotor 41 and stator 42 as it is drawn in suction chamber 13-12; and (3) oil continuously supplied via bores 13-14, 13-15 and 13-16, respectively, to bearings 30, 31 and 32, respectively, is drawn into suction chamber 13-12. The suction, motor cooling and bearing lubricating flows combine in suction chamber 13-12 and flow into the expanding volumes being formed between pairs of coacting rotors.

The present invention eliminates bores 13-14, 13-15 and 13-16 and orifices 30-1*b*, 31-1*a* and 32-1*a* and thereby the separate lubrication flow to the inlet bearings. Additionally, oil separation for inlet bearings 30, 31 and 32 is not required. To provide the required lubrication, the bearing retainers and the bridge or webbing are modified such that a portion of the suction and motor cooling flow passes through/over the inlet bearings to cool and lubricate them. Because bearings 30, 31 and 32 are relatively lightly loaded, and because the bearings, if cool, do not require much oil, the oil entrained in the refrigerant has been found to be sufficient for lubrication. The suction and motor cooling flows through the bridge or webbing 113-1 supporting inlet bearings 30, 31 and 32 tends to keep these bearings cooler then in traditional screw machine designs. Accordingly, a separate flow of lubricant to the inlet bearings, as in the FIG. 1 configuration, can be eliminated.

Referring specifically to FIGS. 4 through 6 and 8, screw machine 110 structurally differs from screw machine 10 solely in bridge or webbing 113-1 of rotor motor housing 113 and inlet bearing retainers 130-1, 131-1 and 132-1 so that only modified structure has been renumbered in FIGS. 4 through 6 and 8. The modified bridge structure 113-1 changes the flow of the suction and motor cooling flow relative to inlet bearings 30, 31 and 32, as contrasted to the flow relative to bearings 30, 31 and 32 of the FIG. 1 configuration. Bridge or webbing 113-1, like bridge or webbing 13-1, defines a plurality of bypass passages relative to casing 113 providing fluid communication between suction chamber 13-12 and the coacting pairs of rotors. Bearing retainers 131-1 and 132-1 are received in bores 113-6 and 113-7, respectively. Additionally, bores 113-2 and 113-3 which receive bearings 31 and 32, respectively, and their coaxial bores 113-2' and 113-3' respectively, together with bores 113-6 and 113-7, respectively, extend through bridge or webbing 113-1. Bore 113-4 receives bearing 30 and is coaxial with bore 113-4' which is opened up so as to permit a portion of the suction and motor cooling flows to pass through the annular opening defined between bore 113-4' and rotor 20.

Figure 7:
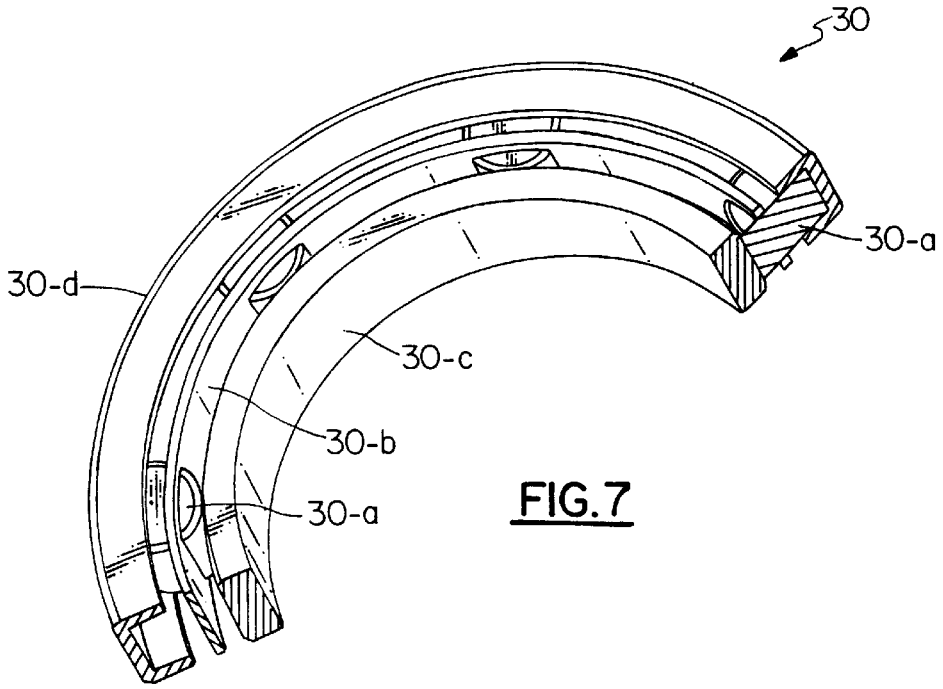
FIG. 7 is a partial view of an inlet bearing.

Referring to FIG. 7 which specifically illustrates inlet bearing 30 but is also representative of bearings 31 and 32, it will be noted that generally cylindrical rollers 30-*a* are located between inner race 30-*c* and outer race 30-*d*. Additionally, rollers 30-*a* are circumferentially spaced by cage 30-*b*. This structure results in a plurality of flow paths between the cage 30-*b* and the inner race 30-*c* and between the cage 30-*b* and outer race 30-*d*. The circumferential extent of the flow paths through bearing 30 corresponds to the circumferential spacing of adjacent rollers 30-*a*. In the FIG. 1 configuration, the bearing retainers 30-1, 31-1 and 32-2 in conjunction with restrictions or orifices 30-1*b*, 31-1*a* and 32-1*a* permit only limited flow of lubricant into the suction flow. Accordingly, bearing retainers 30-1, 31-1 and 32-2 must be modified to permit the greater volumetric flow of gas.

Figure 4:
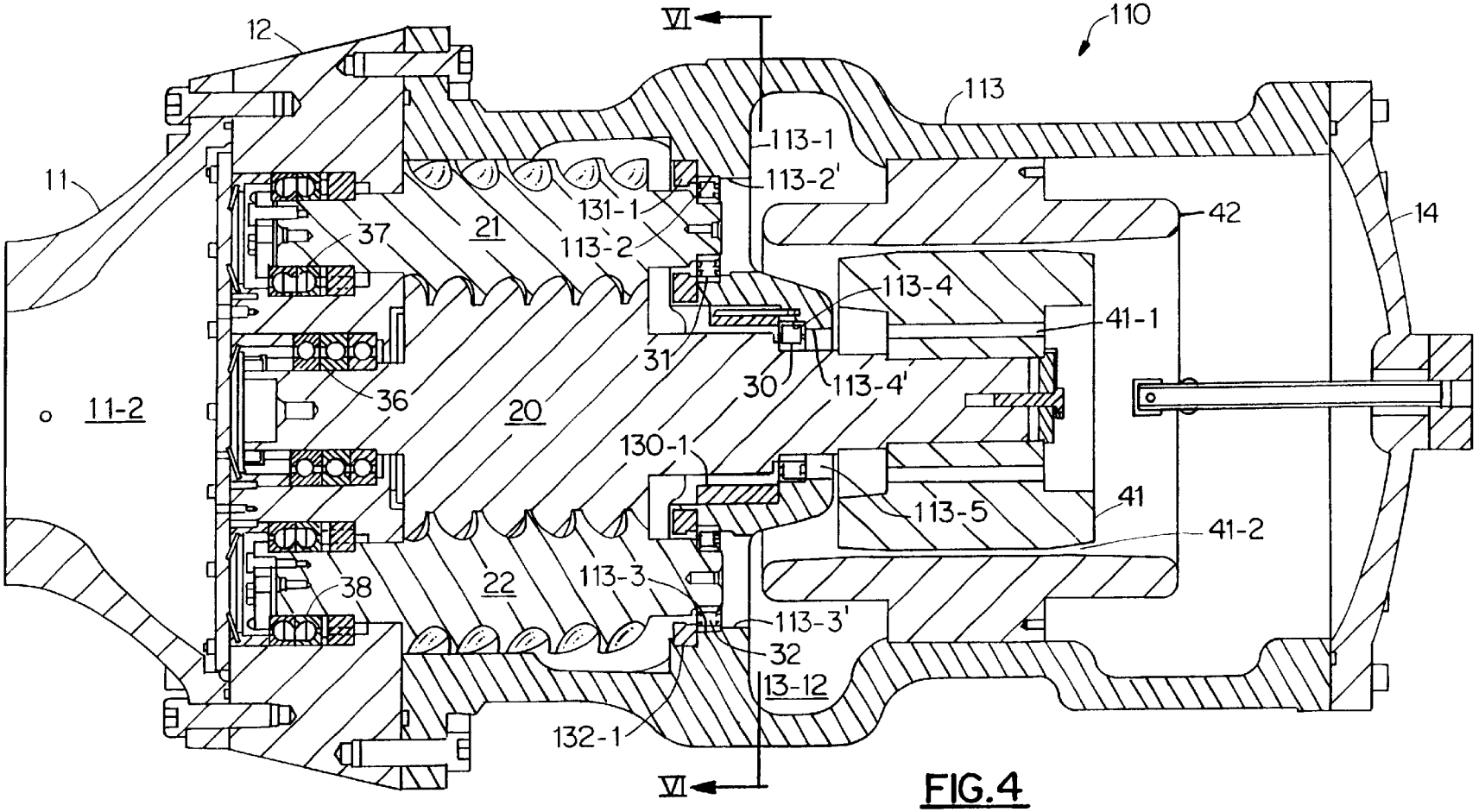
FIG. 4 is a sectional view of a screw machine employing the present invention.
Figure 5:
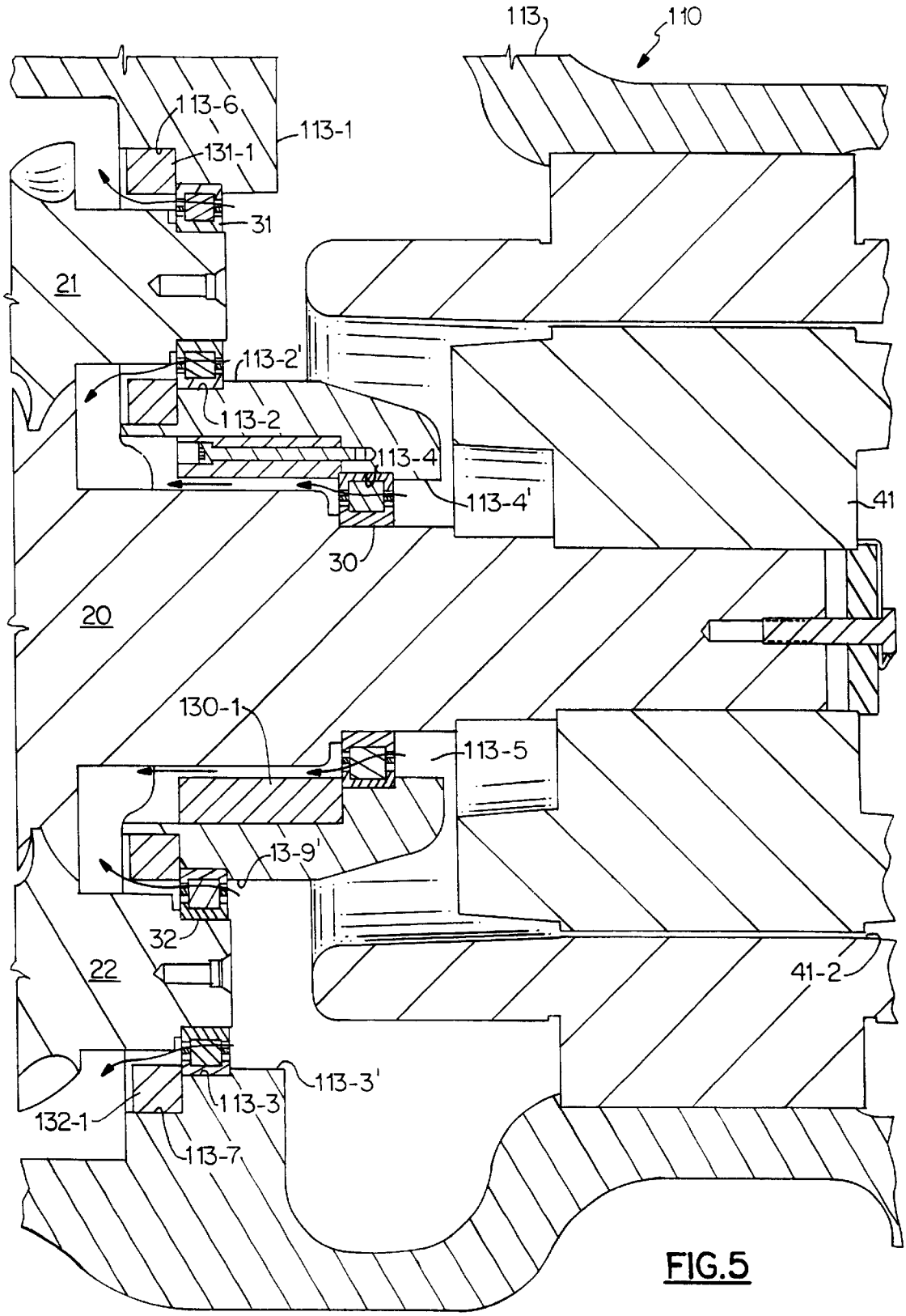
FIG. 5 is an enlarged view of a portion of FIG. 4.
Figure 6:
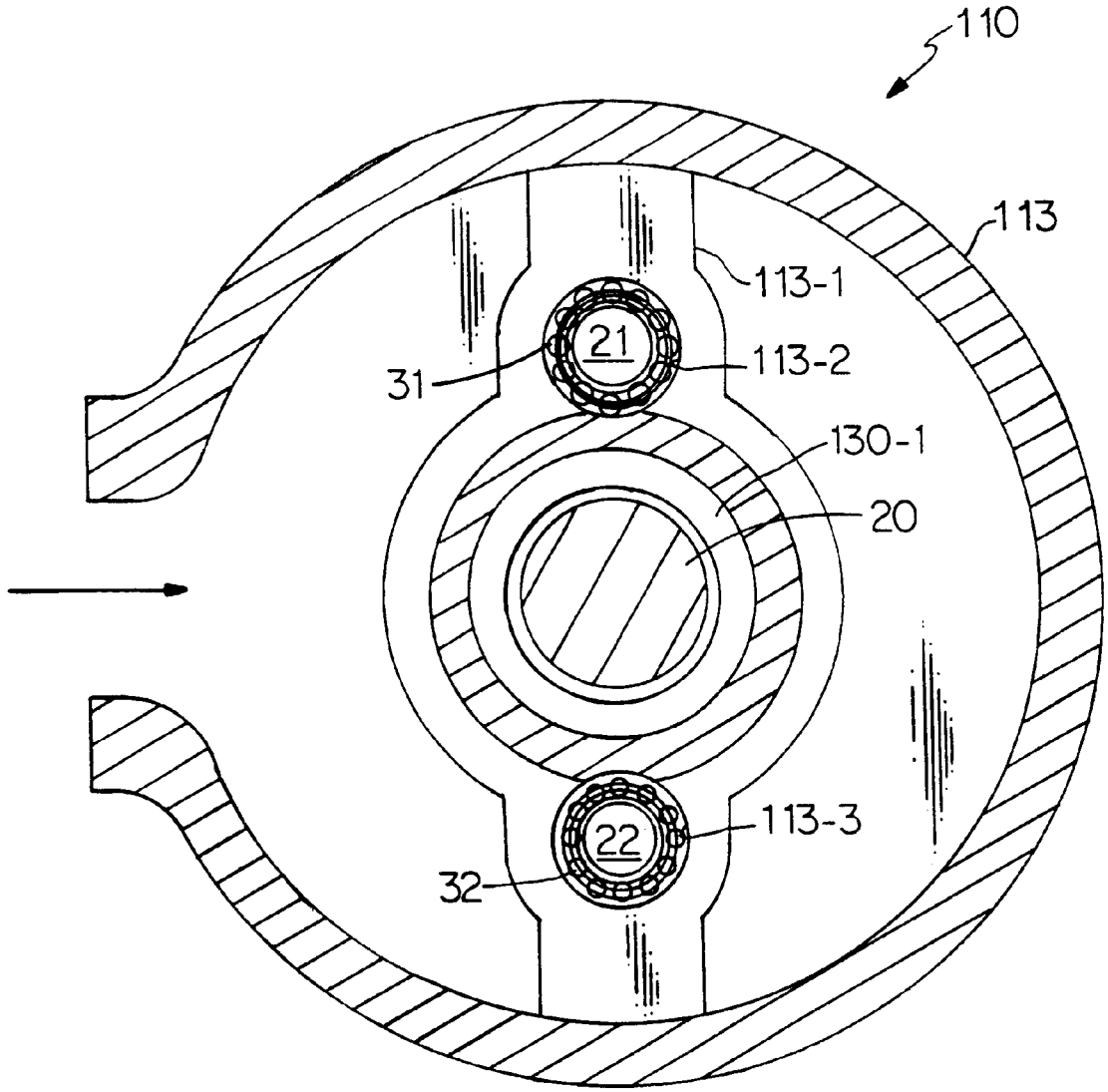
FIG. 6 is a sectional view taken along line VI—VI of FIG. 4.
Figure 8:
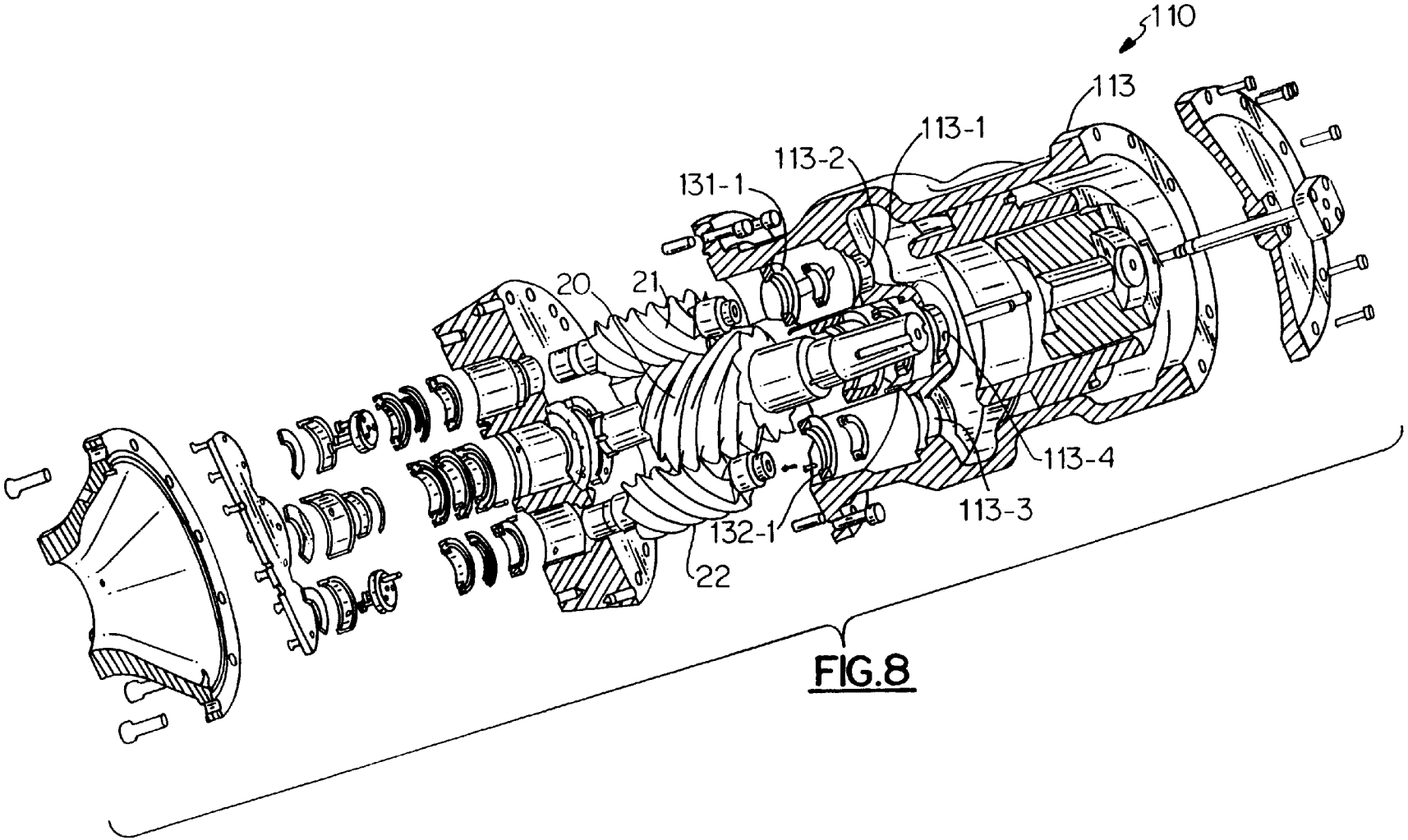
FIG. 8 is a partially sectioned, exploded view of the FIG. 4 device.

In comparing FIGS. 1 and 4, it will be noted that bearing retainer 130-1 differs from bearing retainer 30-1 in that labyrinth seals 30-1*c* are eliminated and bearing retainer 130-1 is spaced from rotor 20 so as to define a flow path therewith. Bore 113-4' is radially spaced from rotor 20 much more than bore 13-5' is spaced from rotor 20. Annular passage 113-5 formed between bore 113-4' and rotor 20 forms a portion of a cooling and lubricating path between suction chamber 13-12 and bearing 30. The flow path continues through bearing 30 and then passes between bearing retainer 130-1 and rotor 20 in the FIG. 4 embodiment but passes from bearing 30 into the suction chamber 13-12 via a restricted passage between rotor 20 and bore 13-5' in the FIG. 1 embodiment. Bearing retainers 131-1 and 132-1 differ from bearing retainers 31-1 and 32-1 only in that they have larger clearances with rotors 21 and 22, respectively. The bore 113-2', bearing 31 and the annular space between bearing retainer 131-1 and rotor 21 defines the cooling and lubricating flow path for bearing 31. Similarly, the bore 113-3', bearing 32 and the annular space between bearing retainer 132-1 and rotor 22 defines the cooling and lubricating flow path for bearing 32.

From the foregoing it should be clear that the device of FIG. 4 differs from that of FIG. 1 in that: (1) all of the inlet bearings are cooled and lubricated by the combined suction and motor cooling flows; (2) the lubricating and cooling flows for each bearing passes through web or bridge 113-1; and (3) the flow paths for the lubricating and cooling flows to the bearings are relatively unrestricted because it is a gaseous flow with entrained oil requiring a greater volumetric flow.

Although a preferred embodiment of the present invention has been described and illustrated, other changes will occur to those skilled in the art. It is therefore intended that the scope of the present invention is to be limited only by the scope of the appended claims.

What is claimed is:

1. A screw machine comprising:

means defining a casing having an inlet and an outlet;

at least two coating rotors located in said casing;

inlet and outlet bearing means for supporting each of said rotors in said casing;

motor means located in said casing for driving one of said rotors;

means for supplying a motor lubricant containing fluid into said casing for cooling said motor;

means for supplying a bearing lubrication containing fluid into said casing via said inlet;

said motor means being located in said casing between said means for supplying a motor lubricant containing fluid into said casing for cooling said motor means and said inlet whereby all of said motor lubricant containing fluid supplied to said casing for cooling said motor means must pass through and thereby cool said motor means before combining with said bearing lubricant containing fluid supplied to said casing via said inlet;

said inlet bearing means providing fluid paths for said bearing lubricant containing fluid supplied via said inlet and for cooling said motor means whereby as said motor means drives said one rotor, at least a portion of said bearing lubricant containing fluid supplied via said inlet and for cooling said motor means passes via said fluid paths and thereby cools and lubricates said inlet bearing means.

2. The screw machine of claim 1 wherein said screw machine is a refrigerant compressor and said bearing lubricant containing fluid supplied via said inlet and for cooling said motor means is a refrigerant.

3. The screw machine of claim 1 wherein each of said inlet bearing means includes a bearing retainer annularly spaced from a corresponding one of said rotors with each of said annular spacings forming portions of said fluid paths downstream of corresponding ones of said inlet bearings.

* * * * *